US005507670A

United States Patent [19]

Ogawa

[11] Patent Number: 5,507,670

[45] Date of Patent: Apr. 16, 1996

[54] BULB SOCKET

[75] Inventor: Shinji Ogawa, Yokkaichi, Japan

[73] Assignee: Sumitomo Wiring Systems, Ltd., Mie, Japan

[21] Appl. No.: 295,026

[22] Filed: Aug. 25, 1994

[30] Foreign Application Priority Data

Sep. 7, 1993 [JP] Japan ..... 5-247447

[51] Int. Cl.[6] ..... H01R 33/09

[52] U.S. Cl. ..... 439/699.1; 439/617

[58] Field of Search ..... 439/617, 699.1, 439/699.2, 736, 619

[56] References Cited

U.S. PATENT DOCUMENTS

| | | | |
|---|---|---|---|
| 4,687,965 | 8/1987 | Sanders | 439/617 X |
| 4,871,331 | 10/1989 | Kondo et al. | 439/736 |
| 5,000,702 | 3/1991 | Forish et al. | 439/699.2 |
| 5,121,304 | 6/1992 | Hall | 439/617 X |
| 5,154,645 | 10/1992 | Harada | 435/736 |
| 5,286,223 | 2/1994 | Ogawa | 439/619 |
| 5,411,410 | 5/1995 | Ogawa et al. | 439/619 X |

FOREIGN PATENT DOCUMENTS

| | | |
|---|---|---|
| 1-86085 | 6/1989 | Japan . |
| 2-47787 | 4/1990 | Japan . |

*Primary Examiner*—William Briggs
*Attorney, Agent, or Firm*—Oliff & Berridge

[57] ABSTRACT

A bulb socket that avoids the various disadvantages caused by insert molding of a terminal of a complicated shape and also satisfies characteristics required for different portions of the terminal. A housing body is made of a plastic material and includes a socket housing for receiving a base portion of a bulb and a connector housing for receiving a feeder connector. Each connector-side terminal is of a generally L-shape and has a connector tab portion and a relay tab portion extending perpendicularly from this connector tab portion. Bulb-side terminals are provided in the socket housing at corner portions thereof in opposed relation to each other and function to mechanically hold the base portion of the bulb, and also function to electrically contact lead wires on the base portion, respectively. This bulb-side terminal has a relay terminal portion formed at a lower end thereof, which portion can be press-fitted on the relay tab portion of the connector-side terminal.

11 Claims, 9 Drawing Sheets

BULB SOCKET

BACKGROUND OF THE INVENTION

This invention relates to a bulb socket with a connector, and more particularly to a bulb socket having an improved terminal construction, as well as a method of producing such a bulb socket.

In a bulb socket of this kind, a connector housing is formed integrally with a socket housing of a plastic material, and terminals are provided therein. Conventionally, this terminal includes an integral bulb-side terminal portion exposed in the socket housing for contact with a bulb and an integral connector-side terminal portion exposed in the connector housing for contact with a feeder connector, and this terminal is fixed to the housing by insert molding during the molding of the socket housing.

In the bulb socket of the above construction, however, the terminal has a complicated shape, and therefore there has been encountered a problem that the cost of a mold for insert molding is high. Because the terminal is large in size and is complicated in shape, the dimensional accuracy of the terminal is poor. As a result, there have arisen problems in that resin flows into the terminal during insert molding, the terminal interferes with and may be deformed by a mold, and the retaining of the terminal by the mold becomes inadequate, so that the deformation of the terminal by a resin-injecting pressure, as well as an improper flow of the resin, can easily develop. Moreover, because of the complicated shape of the terminal, it is, in some cases, difficult to use an automation system employing a part feeder, which is disadvantageous from the viewpoint of manufacturing costs.

Furthermore, since the terminal is of an integral construction formed from a single electrically-conductive plate, the bulb-side terminal portion for contact with the bulb and the connector-side terminal portion for contact with the connector are made of the same material. However, for example, the connector-side terminal portion should preferably have a plate thickness of about 0.6 mm in connection with the associated connector, whereas the bulb-side terminal portion should preferably have a plate thickness of about 0.4 mm to secure a pressure of contact with the bulb. Thus, despite the fact that the characteristics required for different portions are different, these could not be satisfied with the conventional terminal.

SUMMARY OF THE INVENTION

It is an object of this invention to provide a bulb socket which can overcome the various problems caused by insert molding of a terminal of a complicated shape, and can reduce the cost by automating the manufacture, and can satisfy characteristics required for different portions of the terminal. It is also an object to provide a method of producing such a bulb socket.

According to the present invention, there is provided a bulb socket comprising a socket housing of an insulative material; a connector housing integrally connected to the socket housing; connector-side terminals mounted within the connector housing for connection to a feeder connector; and bulb-side terminals mounted within the socket housing, the bulb-side terminals being produced separately from the connector-side terminals. Each of the bulb-side terminals have a bulb contact portion for contact with a bulb inserted in the socket housing and a relay terminal portion held in contact with a respective one of the connector-side terminals.

In the production of the bulb socket of the above construction, after the connector-side terminals are press-fitted in the connector housing to be fixed thereto, each of the bulb-side terminals is fixed within the socket housing in such a manner that the relay terminal portion is connected to a respective one of the connector-side terminals.

In the bulb socket, two kinds of terminals are used, that is, the connector-side terminals and the bulb-side terminals, and therefore a material can be selected so as to satisfy the characteristics required for each of the terminals. Because one connector-side terminal and one bulb-side terminal can be used on several common bulb sockets without exchange, the number of common parts increases even in the manufacture of various kinds of products, thus decreasing a total number of different parts. In addition, each of the terminals is much simpler in shape than the conventional integral-type terminal, and therefore in the manufacture of the bulb socket, an automation system using a part feeder can be employed. Even if an insert molding is partially used, the dimensional accuracy of the terminals can be made high because of the simple shape of the terminals, and a flow of a resin in the terminals during the insert molding, the deformation of the terminal by interference with a mold, and an improper flow of the resin will hardly occur.

In the production method according to the present invention the two kinds of terminals are fixed by press-fitting, and an improper flow of the resin as experienced in the insert molding is eliminated. In addition, the cost can be reduced by an automation system employing a part feeder.

As described above, in the bulb socket of the present invention, the material can be selected so as to satisfy the characteristics required for each terminal, thereby achieving a high performance design. In addition, although the number of the component parts for one kind of bulb socket increases, the number of common parts for various kinds of such bulb sockets increases, and therefore the number of all the parts will not greatly increase, and the production cost can be reduced, for example, by the use of an automation system employing a part feeder. Moreover, insert-molding defects, as encountered with the insert molding of an integral-type terminal of a complicated shape are eliminated, thereby ensuring a high-quality design.

In the production method of the present invention, the cost reduction can be achieved by the use of an automation system, and high-quality design can be achieved by elimination of molding defects.

BRIEF DESCRIPTION OF THE DRAWINGS

These and other objects and advantages of the present invention will become apparent from the following detailed description of preferred embodiment when taken in conjunction with the accompanying drawings, in which.

DETAILED DESCRIPTION OF PREFERRED EMBODIMENTS

A preferred embodiment of the present invention will now be described with reference to the drawings.

Figure 13:
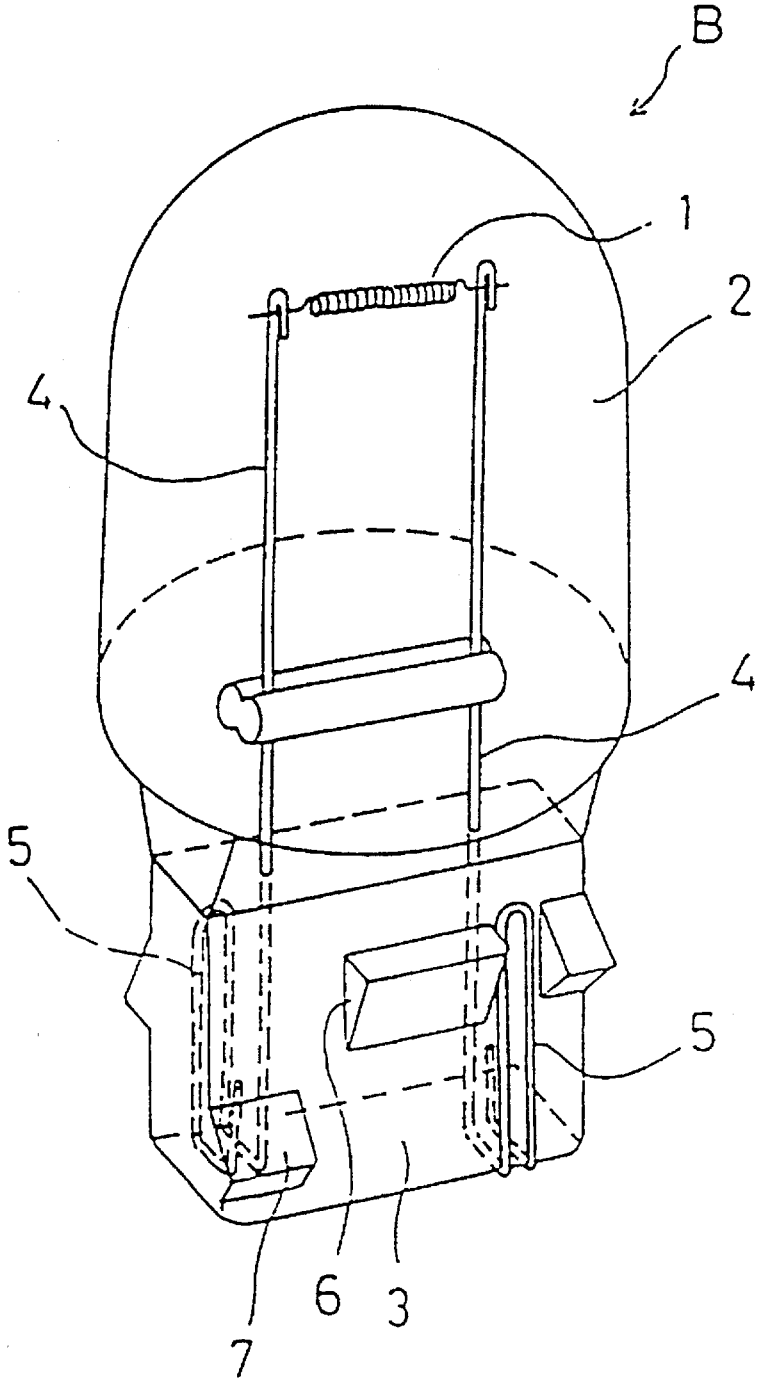
FIG. 13 is a perspective view showing a wedge base-type bulb.

A bulb socket of this embodiment is adapted to hold a wedge base bulb B (hereinafter referred to merely as "bulb B") of the single filament type shown in FIG. 13. The bulb B is of a conventional construction and includes a flat base portion 3 of glass integrally connected to a lower end of a bulb body 2 containing a filament 1. Two lead wires 4, extending from a lower end of the base portion 3, are folded back respectively on opposite (right and left) sides of the base portion 3 to form feeder terminals 5, and projections 6 and 7 are formed on the right and left sides of the base portion 3, respectively.

Figure 1:
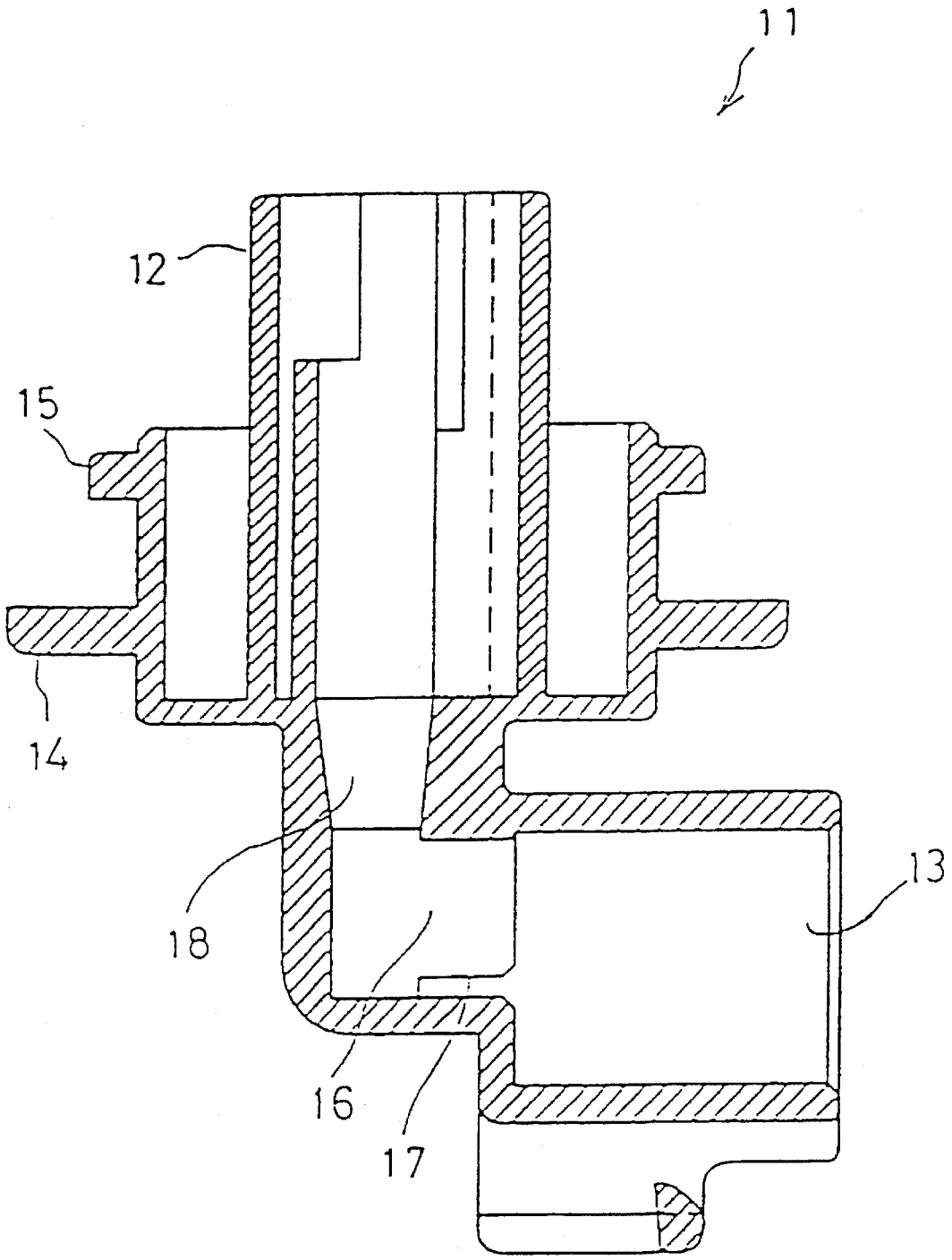
FIG. 1 is a vertical cross-sectional view of a housing body of one preferred embodiment of the present invention.

A housing body 11 of the bulb socket is made of a plastic material and includes a socket housing 12 for receiving the base portion 3 of the bulb B and a connector housing 13 for receiving a feeder connector (not shown), as shown in FIG. 1. The bulb socket is fixedly mounted on a mounting plate (not shown) held between a flange 14 and an engagement projection 15, which are formed on the outer periphery of the socket housing 12. The socket housing 12 and the connector housing ]3 are open respectively in directions perpendicular to each other. The bulb socket is of an L-shape as a whole, as viewed from the side thereof.

Figure 2:
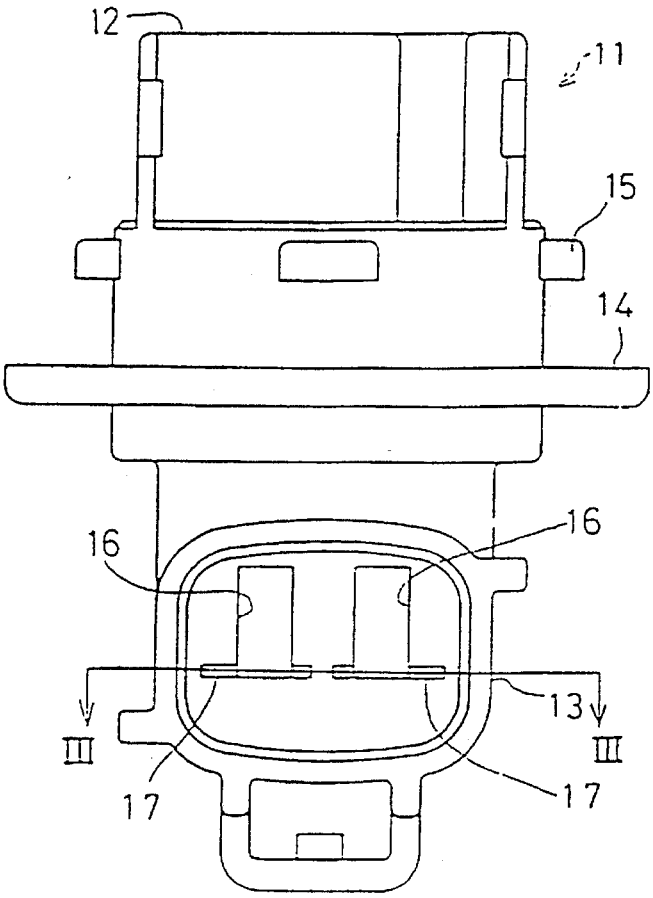
FIG. 2 is a front-elevational view of the housing body.
Figure 3:
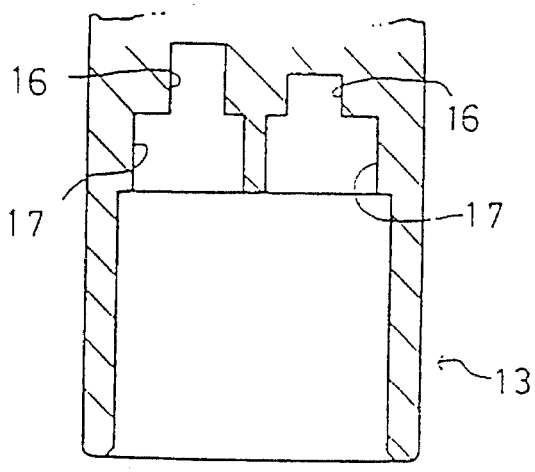
FIG. 3 is a cross-sectional view taken along the line III—III of FIG. 2.

Terminal insertion cavities 16 are formed in an inner end surface of the connector housing 13, as shown in FIGS. 2 and 3, and press-fit grooves 17 are formed in continuous relation to each terminal insertion cavity 16, respectively. A communication cavity 18 is formed in an inner end portion (bottom portion) of the socket housing 12, and is in communication with the terminal insertion cavities 16 in the connector housing 13.

Two kinds of terminals, that is, two connector-side terminals 20 of the same shape and two bulb-side terminals 30 of the same shape, are mounted on this bulb socket, and these terminals will be described below in detail.

Figure 4:
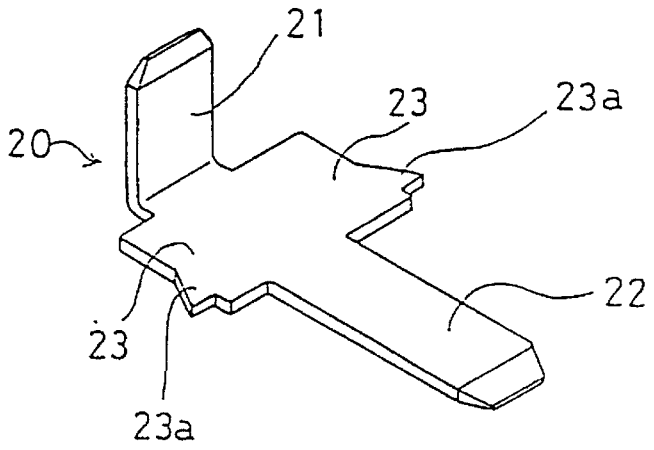
FIG. 4 is a perspective view of a connector-side terminal.
Figure 5:
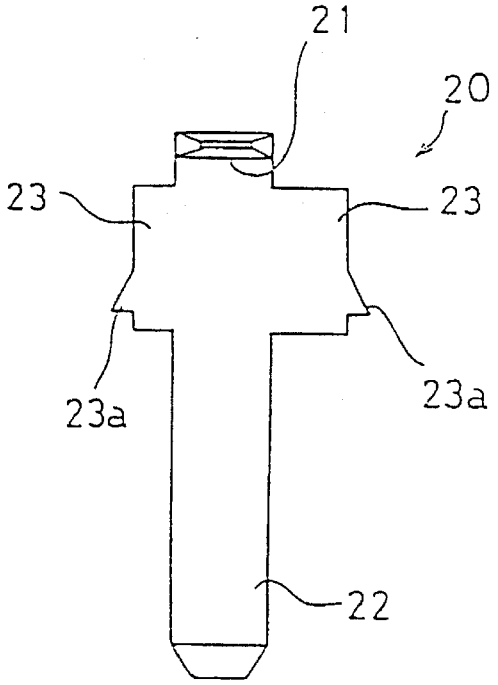
FIG. 5 is a plan view of a connector-side terminal.

As shown in FIGS. 4 and 5, the connector-side terminal 20 is L-shaped as a whole and has a connector tab portion 22 for connection to a receptacle (not shown) of the feeder connector and a relay tab portion 21 extending perpendicularly from the connector tab portion for connection to the bulb-side terminal 30. A pair of press-fit projections 23 are formed on and extend respectively from opposite (right and left) edges of a proximal end portion of the connector tab portion 22 (which is adjacent to a bent portion), assuming a wing-like configuration. A retaining portion 23*a* is formed on a distal end of each of these press-fit projections. This connector-side terminal 20 is formed of an electrically-conductive material having a plate thickness, for example, of about 0.64 mm so that the connector tab portion 22 can have optimal characteristics.

Figure 6:
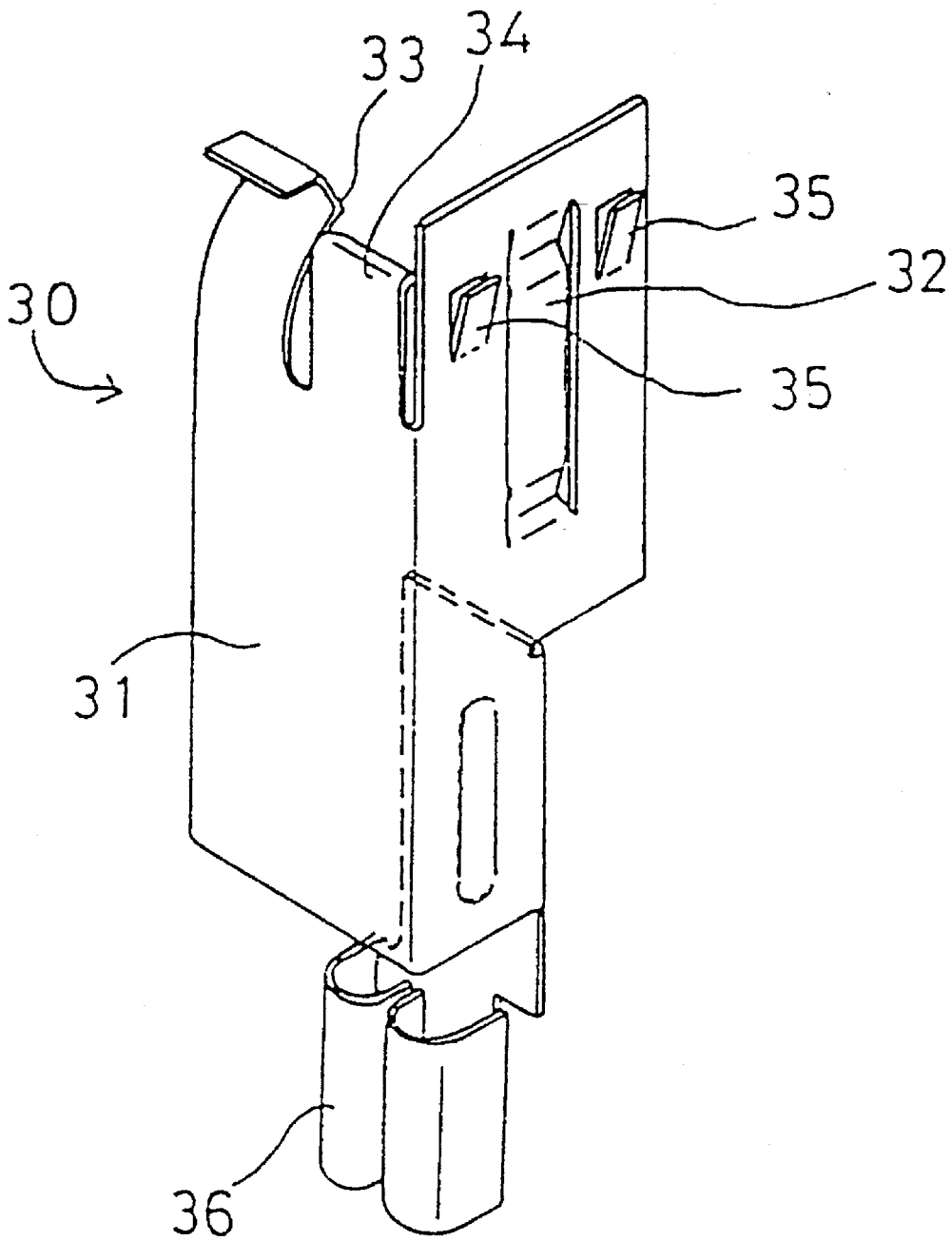
FIG. 6 is a perspective view of a bulb-side terminal.
Figure 7:
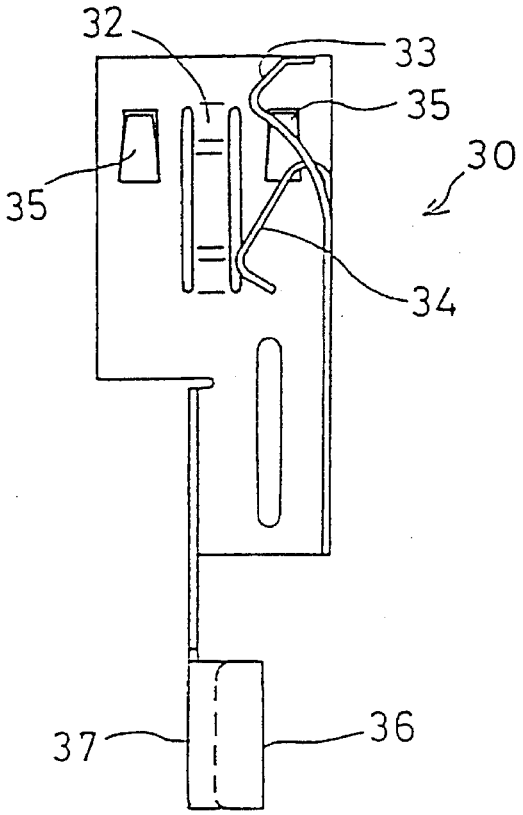
FIG. 7 is a side-elevational view of bulb-side terminal.
Figure 8:
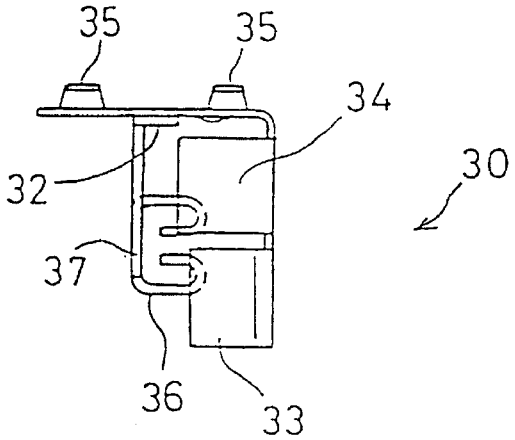
FIG. 8 is a plan view of a bulb-side terminal.
Figure 9:
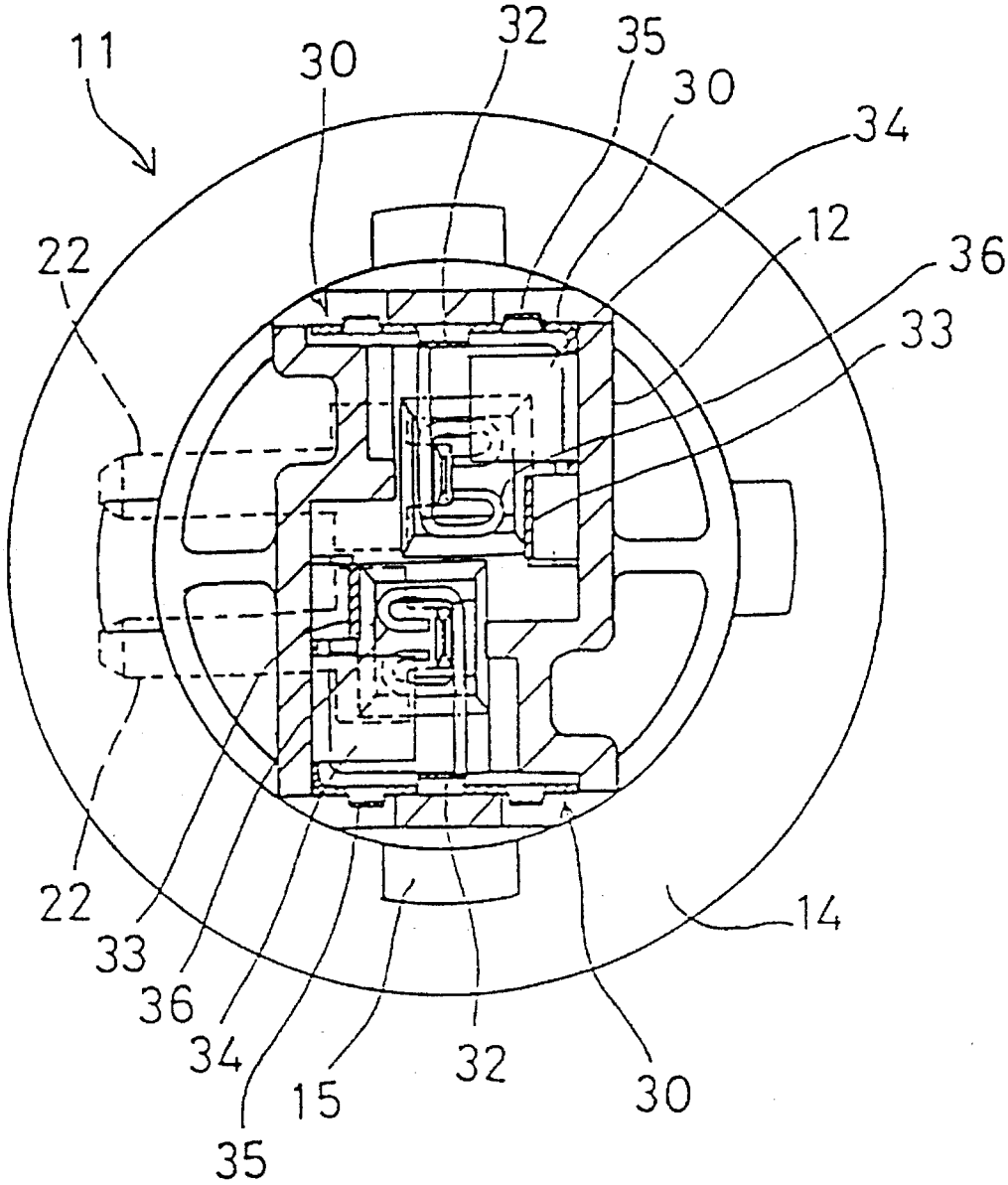
FIG. 9 is a cross-sectional view showing the two kinds of terminals attached to a housing body.
Figure 10:
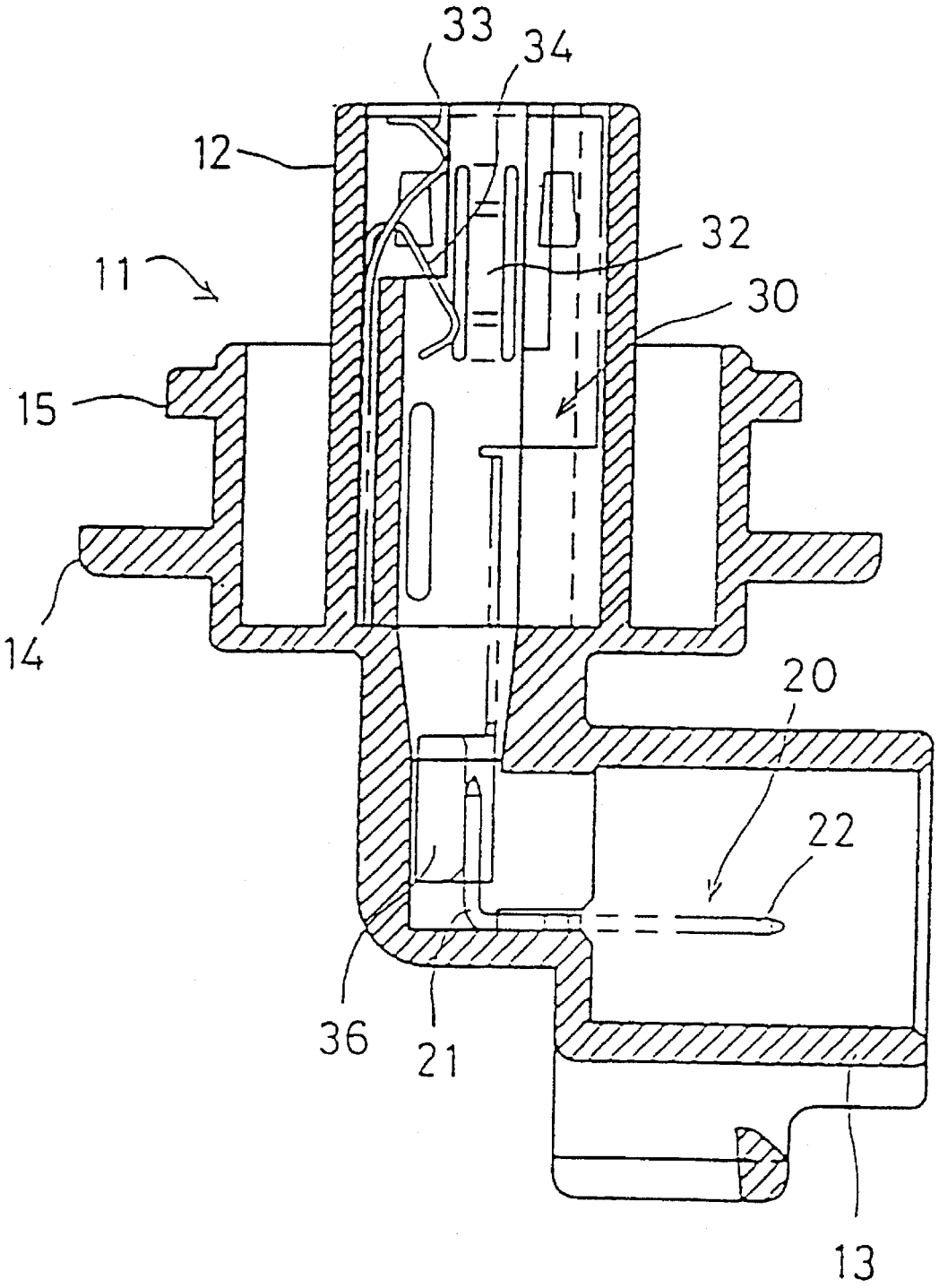
FIG. 10 is a vertical cross-sectional view showing the two kinds of terminals attached to a housing body.
Figure 11:
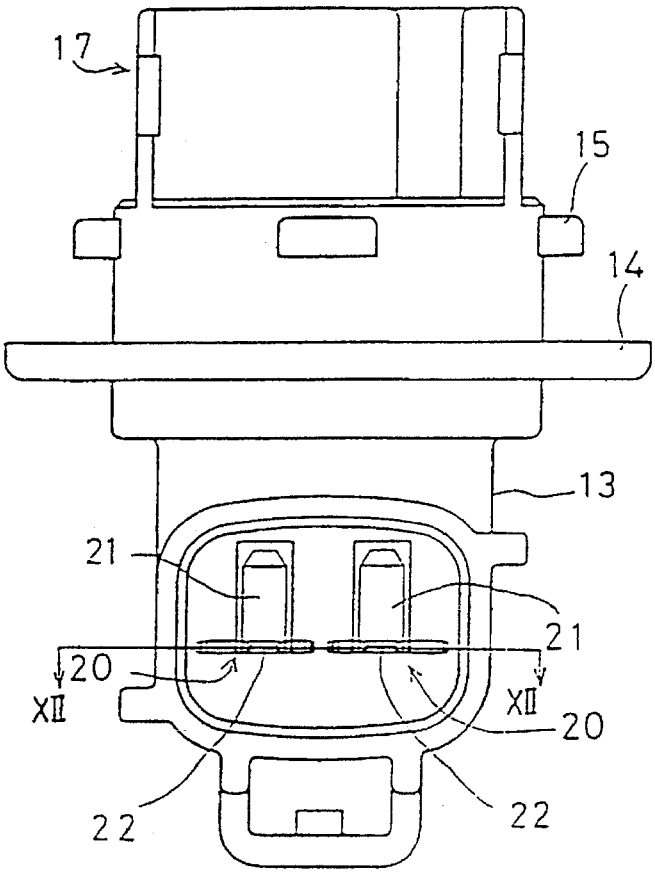
FIG. 11 is a front-elevational view of an embodiment of the present invention.
Figure 12:
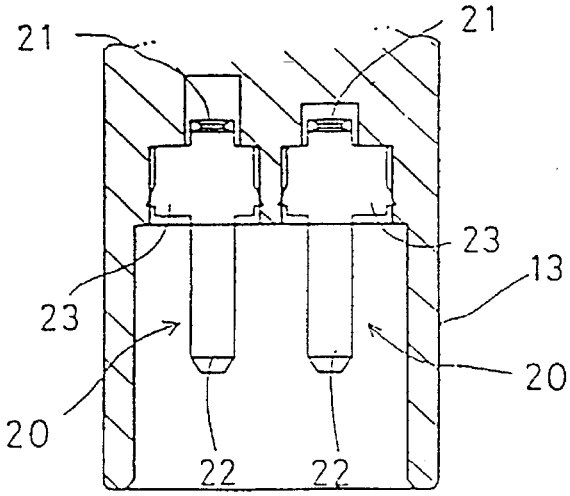
FIG. 12 is a cross-sectional view taken along the line XII—XII of FIG. 11.

The bulb-side terminal 30 is shaped as shown in FIGS. 6 to 8, and these terminals 30 are provided in the socket housing 12 at corner portions thereof in opposed relation to each other. An upper portion of the terminal 30 defines a bulb contact portion 31 bent into an L-shape as viewed from the top, and functions to mechanically hold the base portion 3 of the bulb B, and also functions to electrically contact the lead wire 4. More specifically, each of these bulb contact portions has a bulged, stamped resilient holder portion 32 adapted to be held respectively against the right and left sides of the base portion 3. Also, each bulb contact portion has a resilient clamping portion 33 formed by bending, these clamping portions 33 being adapted to be held respectively against the front and rear sides of the base portion 3. A feeder electrode 34, which is downwardly bent or directed, is provided at a level below the resilient clamping portion 33. The feeder electrode 34 contacts the lead wire 4, with the base portion 3 mechanically held by the bulb contact portion 31. Two retaining pieces 35 are formed respectively on opposite sides of the resilient holder portion 32, each retaining piece 35 being formed by stamping in a manner to provide an upwardly-open portion. The bulb-side terminal 30 is formed of an electrically-conductive material having a plate thickness, for example, of about 0.4 mm so that this terminal 30 can provide a sufficient force to hold the base portion 3 of the bulb B and also can provide a proper pressure of contact with the lead wire 4.

A relay terminal portion 36 is formed at a lower end of the bulb contact portion 31 by bending each of right and left side portions of a downwardly-extending relay conductor 37 into an arcuate cross-sectional shape, 15 thus providing a so-called receptacle configuration. This relay terminal portion 36 can be press-fit on the relay tab portion 21 of the connector-side terminal 20 from the upper side to be connected thereto.

Next, a method of producing the bulb socket of the above construction will now be described.

The two kinds of terminals, that is, the connector-side terminals 20 and the bulb-side terminals 30, are made of predetermined materials, respectively. The housing body 11, having the socket housing 12 and the connector housing 13, which are integral with each other, is formed of a plastic material, for example, by injection molding. At this time, an insert molding (in which terminals are beforehand set in a mold) as used in the conventional construction is not carried out, and therefore a resin can flow satisfactorily, so that the terminals will not be deformed.

After the molding of the housing body 11, the two connector-side terminals 20 are press-fitted into the connector housing 13. Here, the connector-side terminal 20 is inserted into the terminal insertion cavity 16, with the relay tab portion 21 directed inwardly, and the two press-fit projections 23 and 23, formed at the proximal end portion of the connector tab portion 22, are press-fitted in the press-fit grooves 17 and 17, respectively. At this time, the press-fit projections 23 are forced respectively into the press-fit grooves 17, and the retaining portions 23*a* bite the inner surfaces of the press-fit grooves 17, so that the connector-side terminal 20 is fixed within the connector housing 13 against withdrawal. In this condition, the connector tab portion 22 of the connector-side terminal 20 is extended in a recumbent manner within the connector housing 13, whereas the relay tab portion 21 is extended upwardly in the communication cavity 18.

Then, the two bulb-side terminals 30 are incorporated into the socket housing 12 of the housing body 11. Here, the bulb-side terminal 30 is inserted into a predetermined position in the socket housing 12, with the relay terminal portion 36 directed downwardly, and the relay terminal portion 36 is pushed down from a position just above the relay tab portion 21. As a result, the relay terminal portion 36 is spread by the relay tab portion 21, and they are fitted together, thereby connecting the connector-side terminal 20 and the bulb-side terminal 30 together mechanically and electrically. In this condition, the relay terminal portion 36 is connected to the relay tab portion 21, and the retaining pieces 35 of the bulb-side terminal 30 bite the inner peripheral surface of the socket housing 12. Therefore, the bulb-side terminal 30 is fixed within the socket housing 12 against withdrawal, and the bulb socket is completed.

As described above, in this embodiment, the terminals mounted within the housing body 11 are the two kinds of terminals, that is, the connector-side terminals 20 and the bulb-side terminals 30. Therefore, the connector-side terminal 20 can be formed of an electrically-conductive material having a plate thickness, for example, of about 0.64 mm so that the connector tab portion 22 can have the best characteristics, and the bulb-side terminal 30 can be formed of an electrically-conductive material having a plate thickness, for example, of about 0.4 mm so that this terminal 30 can provide a sufficient force to hold the base portion 3 of the bulb B and can provide a proper pressure contact with the lead wire 4. Therefore, the material can be selected so as to satisfy the characteristics required for each of the terminals 20 and 30, and therefore the bulb socket can have a high performance.

With respect to this type of bulb socket, there have been provided various kinds of products of different specifications, depending on the kind of the mating connector and the kind of the bulb B. Conventionally, the terminals have been different in shape from one product to another, and therefore it has been necessary to prepare many different kinds of terminals, which has greatly increased the number of parts. However, in this embodiment, the connector-side terminals 20 and the bulb-side terminals 30 can be used on a common bulb socket without exchange, and the number of common parts increases even in the manufacture of various kinds of products, thus decreasing a total number of the parts.

In addition, each of the terminals 20 and 30 is much simpler in shape than the conventional integral-type terminal. Therefore, in the step of press-fitting the connector-side terminal 20 and in the step of incorporating the bulb-side terminal 30, a part feeder can be used for conveying the terminals 20 and 30. Therefore, although the number of the terminals for one kind of product is larger as compared with the conventional construction using the integral-type terminal, a cost reduction effect, achieved by an automation system using a part feeder, suppresses the cost increase due to an increased number of the parts, and the overall cost is lower.

The present invention is not limited to the embodiment described above and shown in the drawings, and for example the following modifications can be made.

(a) With respect to the production procedure, although after the connector-side terminals are press-fitted in the connector housing, the bulb-side terminals are incorporated into the socket housing, there can be used a reverse production procedure in which the bulb-side terminals are press-fitted and fixed in the socket housing, and the connector-side terminals are incorporated into the connector housing. In this case, also, the two mating terminals are electrically connected together through the relay terminal portion.

(b) In the above embodiment, although the two kinds of terminals are fixed to the housing body by press-fitting or insertion, one terminal may be integrally attached to the housing body by insert molding, and the other terminal may be fixed to the housing body by press-fitting or insertion. Even if the insert molding is thus partially used, the separate-type terminals are simpler in shape than the conventional integral-type terminal, and the deformation of the terminals by interference with a mold, as well as an improper flow of a resin, will hardly occur. Because of the use of the separate-type terminals, an automation system employing a part feeder can be used, so that the cost can be reduced. Thus, the intended object of the present invention can be achieved.

(c) In the above embodiment, although a bulb socket for holding the wedge base bulb is shown, the invention can be similarly applied also to a bulb socket for holding a bulb having a metal base.

(d) In the bulb socket having the housing body 11 of a generally L-shape as in the above embodiment, the shape of terminals is more complicated as compared with a linear-type socket having a downwardly-open connector housing, and therefore the effects of the invention are most advantageous. However, the invention can, of course, be applied to such a linear-type bulb socket.

Furthermore, the present invention can be applied not only to the socket for a bulb of the single filament-type but also to a socket for a bulb of the double filament-type, and many other modifications can be made without departing from the scope of the invention.

What is claimed is:

1. A bulb socket for holding a bulb and for providing an electrical connection between a feeder connector and an electrical lead on the bulb, comprising:

a housing body formed of an electrically insulative material and comprising:

a connector housing portion connectable with a feeder connector, a socket housing portion for receiving and retaining a light bulb, and a connecting cavity connecting the connector housing portion and the socket housing portion;

at least one electrically conductive L-shaped connector-side terminal mounted in the connector housing portion and connectable with a feeder connector, and having a relay tab portion forming one leg of said L-shape and extending into the connecting cavity; and at least one electrically conductive bulb-side terminal mounted in said socket housing portion and comprising:

a feeder electrode for contacting an electrical lead on a bulb inserted in the socket housing portion, and a relay terminal portion extending into the connecting cavity and electrically connected to said relay tab portion.

2. A bulb socket for holding a bulb and for providing an electrical connection between a feeder connector and an electrical lead on the bulb, comprising:

a housing body formed of an electrically insulative material and comprising:

a connector housing portion connectable with a feeder connector, a socket housing portion for receiving and retaining a light bulb, and a connecting cavity connecting the connector housing portion and the socket housing portion;

at least one electrically conductive connector-side terminal mounted in the connector housing portion and connectable with a feeder connector, and having a relay tab portion extending into the connecting cavity, wherein terminal grooves are integrally formed in the connector housing portion and wherein the at least one connector-side terminal further comprises projections that are press-fittable into the grooves to mount the connector-side terminal in the connector housing portion; and at least one electrically conductive bulb-side terminal mounted in said socket housing portion and comprising:

a feeder electrode for contacting an electrical lead on a bulb inserted in the socket housing portion, and a relay terminal portion extending into the connecting cavity and electrically connected to said relay tab portion.

3. The device of claim 2, wherein the at least one bulb-side terminal further comprises a clamping portion for retaining a bulb inserted into the socket housing portion.

4. The device of claim 2, wherein the at least one bulb-side terminal further comprises a resilient holder portion for engaging and retaining a bulb inserted into the socket housing portion.

5. The device of claim 2, wherein the at least one bulb-side terminal further comprises at least one retaining projection extending from the at least one bulb-side terminal for engaging an interior wall of the socket housing portion to retain the at least one bulb-side terminal in the socket housing portion.

6. The device of claim 1, wherein the at least one bulb-side terminal further comprises a clamping portion for retaining a bulb inserted into the socket housing portion.

7. The device of claim 2, wherein a longitudinal axis of the connector housing portion is substantially perpendicular to a longitudinal axis of the socket housing portion.

8. The device of claim 7, wherein the at least one connector side terminal includes a connector tab portion connectable to a feeder connector and wherein the relay tab portion extends from the connector tab portion into the connecting cavity at an angle of approximately 90°.

9. The device of claim 1, wherein the at least one bulb-side terminal further comprises a resilient holder portion for engaging and retaining a bulb inserted into the socket housing portion.

10. The device of claim 1, wherein the at least one bulb-side terminal further comprises at least one retaining projection extending from the at least one bulb-side terminal for engaging an interior wall of the socket housing portion to retain the at least one bulb-side terminal in the socket housing portion.

11. The device of claim 1, wherein terminal grooves are integrally formed in the connector housing portion and wherein the at least one connector-side terminal further comprises projections that are press-fittable into the grooves to mount the connector-side terminal in the connector housing portion.

* * * * *